US011525171B2

(12) United States Patent
Lee et al.

(10) Patent No.: US 11,525,171 B2
(45) Date of Patent: Dec. 13, 2022

(54) ROSE-GOLD-COLORED COPPER ALLOY AND VEHICLE INTERIOR MATERIAL USING THE SAME

(71) Applicants: Hyundai Motor Company, Seoul (KR); Kia Motors Corporation, Seoul (KR); Industry-Academia Cooperation Group of Sejong University, Seoul (KR)

(72) Inventors: Hoo-Dam Lee, Seongnam-si (KR); Chang-Yeol Yoo, Suwon-si (KR); Jong-Kook Lee, Suwon-si (KR); Sung-Ho Yoon, Suwon-si (KR); Ye-Lim Kim, Anyang-si (KR); Yeon-Beom Jeong, Seoul (KR); Ki-Buem Kim, Seoul (KR)

(73) Assignees: Hyundai Motor Company, Seoul (KR); Kia Motors Corporation, Seoul (KR); Industry-Academia Cooperation Group of Sejong University, Seoul (KR)

( * ) Notice: Subject to any disclaimer, the term of this patent is extended or adjusted under 35 U.S.C. 154(b) by 177 days.

(21) Appl. No.: 16/681,298

(22) Filed: Nov. 12, 2019

(65) Prior Publication Data

US 2020/0190629 A1 Jun. 18, 2020

(30) Foreign Application Priority Data

Dec. 17, 2018 (KR) ..... 10-2018-0163536

(51) Int. Cl.
*C22C 9/04* (2006.01)

(52) U.S. Cl.
CPC ..... *C22C 9/04* (2013.01)

(58) Field of Classification Search
CPC ..... C22C 1/02
See application file for complete search history.

(56) References Cited

U.S. PATENT DOCUMENTS 5,004,520 A * 4/1991 Tsuji ..... H01L 23/49866 216/14
2014/0308159 A1 10/2014 Clark et al.
2015/0368756 A1 12/2015 Dubos et al.

FOREIGN PATENT DOCUMENTS

CN 105443547 A 3/2016
CN 105624459 A 6/2016
JP 07-062274 A 7/1995
KR 20050004368 A 1/2005
KR 20110004050 A 1/2011

* cited by examiner

*Primary Examiner* — Robert S Jones, Jr.
*Assistant Examiner* — Jiangtian Xu
(74) *Attorney, Agent, or Firm* — Fox Rothschild LLP

(57) ABSTRACT

A vehicle interior material made of a rose-gold-colored copper alloy may include 0.07 to 0.21 wt % of aluminum (Al), 0.06 to 0.19 wt % of magnesium (Mg), 0.17 to 0.52 wt % of zinc (Zn), and a balance of copper (Cu) and unavoidable impurities, wherein the sum of the aluminum (Al), the magnesium (Mg), and the zinc (Zn) is 0.5 to 1.5 at %.

10 Claims, 1 Drawing Sheet

| NAME | L | a | b | NOTE |
|---|---|---|---|---|
| COPPER | 86.76 | 13.76 | 16.83 | 100% Cu |
| RED COPPER | 85.51 | 13.44 | 16.23 | 99Cu-1P (C1120) |
| BRONZE | 89.16 | 8.54 | 16.10 | Cu-8Sn-0.03P(C5210) |
| BRASS | 90.71 | -1.09 | 23.66 | Cu-35.5Zn (C2680) |
| DEVELOPED ALLOY | 82.5~87.45 | 13.8~15.76 | 16.9~19.72 | CU-X |

| NAME | L | a | b | NOTE |
|---|---|---|---|---|
| COPPER | 86.76 | 13.76 | 16.83 | 100% Cu |
| RED COPPER | 85.51 | 13.44 | 16.23 | 99Cu-1P (C1120) |
| BRONZE | 89.16 | 8.54 | 16.10 | Cu-8Sn-0.03P(C5210) |
| BRASS | 90.71 | -1.09 | 23.66 | Cu-35.5Zn (C2680) |
| DEVELOPED ALLOY | 82.5~87.45 | 13.8~15.76 | 16.9~19.72 | CU-X |

ROSE-GOLD-COLORED COPPER ALLOY AND VEHICLE INTERIOR MATERIAL USING THE SAME

CROSS-REFERENCE(S) TO RELATED APPLICATIONS

This application claims priority to and the benefit of Korean Patent Application No. 10-2018-0163536, filed on Dec. 17, 2018, the entire contents of which are incorporated herein by reference.

FIELD

Exemplary form of the present disclosure relates to a rose-gold-colored copper alloy; particularly to a vehicle interior material made of a rose-gold-colored copper alloy with an optimal amount of a specific element added to copper to realize a rose gold color.

BACKGROUND

The statements in this section merely provide background information related to the present disclosure and may not constitute prior art.

In recent years, in order to improve the emotional quality of vehicles, the interior material for vehicles have been changing from existing plastic to metal, typically using an aluminum alloy to realize a metal texture. Aluminum, however, is limited in its design approach since it has a silvery-white color—generally called a metallic color.

To address this issue, the alloy's surface texture and color are controlled through anodization, but this method is limited in its application because it not only increases process costs due to post-processing but also reduces the inherent texture of the metal.

Despite numerous research to overcome these disadvantages and to replace aluminum alloys with copper alloys, the development of copper alloys applicable to vehicle interior materials is not yet sufficient.

SUMMARY

One form of the present disclosure is directed to a rose-gold-colored copper alloy applicable to a vehicle interior material that is not realized by an existing copper alloy. In particular, the rose-gold-colored copper alloy has optimal amounts of specific elements added to copper (Cu) to realize a rose gold color that, when compared to an existing copper alloy, maintains an a* value indicating red while increasing a b* value indicating yellow in the CIE Lab color space.

The above-mentioned rose-gold-colored copper alloy is produced to have a rose gold color by controlling the amount of elements added thereto within a range in which free of precipitate or crystallization is formed during dissolution or casting, thereby maintaining the same formability as an existing copper alloy while having high hardness. Accordingly, another form of the present disclosure is directed to a vehicle interior material manufactured using a rose-gold-colored copper alloy.

Other advantages of the present disclosure can be understood by the following description and references to variations of the present disclosure. Also, it is obvious to those skilled in the art to which the present disclosure pertains to that the advantages of the present disclosure can be realized by the means as claimed and combinations thereof.

In accordance with one form of the present disclosure, a rose-gold-colored copper alloy includes 0.07 to 0.21 wt % of aluminum (Al), 0.06 to 0.19 wt % of magnesium (Mg), 0.17 to 0.52 wt % of zinc (Zn), and a balance of copper (Cu) and unavoidable impurities, referring to impurities that may be inadvertently added to a copper alloy or copper.

The present disclosure is characterized to realize a rose gold color by combining aluminum (Al), magnesium (Mg), and zinc (Zn) with copper (Cu) in the above amounts. To this end, the sum of aluminum (Al), magnesium (Mg), and zinc (Zn) may be 0.5 to 1.5 at %.

Only when the sum of the elements is 2 at % or more do both the a* value indicating red in the CIE Lab color space and the b* value indicating yellow in the CIE Lab color space decrease compared to the respective CIE Lab color space values of an existing copper. Accordingly, the sum of the elements is preferably in the above range.

The atomic fraction of aluminum (Al), magnesium (Mg), and zinc (Zn) may be 0.5 to 1.5:0.5 to 1.5:0.5 to 1.5. When the condition of the above atomic fraction is satisfied, the a* value indicating red in the CIE Lab color space increases.

To satisfy the chromaticity value, however, the amount of aluminum should preferably be smaller than the sum of the amount of magnesium and zinc (Al<Mg+Zn), while the amount of magnesium (Mg) or zinc (Zn) may be equal to or larger than that of the remaining element.

Formation of precipitate or crystallization in the rose-gold-colored copper alloy may be prevented by controlling the element content thereof. Thus, the copper alloy having high hardness and excellent formability balance can be obtained so that the rose-gold-colored copper alloy may be thinned to a thickness of 0.2 mm or less during hot rolling at a reduction rate of 20% at 500° C.

The rose-gold-colored copper alloy may have a surface hardness of 70 Hv or more.

The rose-gold-colored copper alloy may have an L* value of 82.50 to 87.45, an a* value of 13.80 to 15.76, and a b* value of 16.90 to 19.72 in the CIE Lab color space.

As described above, the rose-gold-colored copper alloy may be thinned to a thickness of 0.2 mm or less during hot rolling at a reduction rate of 20% at 500° C. Accordingly, a vehicle interior material may be manufactured using the rose-gold-colored copper alloy of the present disclosure. Here, the vehicle interior material refers to various materials used for different parts inside the vehicle. Examples of the vehicle interior material include, but is not limited to, a center fascia, a dashboard, a console box, an instrument panel, and a door trim.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which:

FIG. 1 illustrates a range of color coordinate values (L*, a*, and b*) in the CIE Lab color space for a rose-gold-colored copper alloy of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

One form of the present disclosure will be described below in more detail with reference to comparative examples so that those skilled in the art can easily carry out the present disclosure.

The terminology used in the specification is for the purpose of describing particular variations only and is not intended to limit the disclosure. As used in the disclosure and the appended claims, the singular forms "a", "an" and "the" are intended to include the plural forms as well, unless context clearly indicates otherwise. It will be further understood that the terms "comprises/includes" and/or "comprising/including" when used in this specification, specify the presence of stated features, integers, steps, operations, elements, components, and/or groups thereof, but do not preclude the presence or addition of one or more other features, integers, steps, operations, elements, components, and/or groups thereof.

In the present disclosure, "% by weight (wt %)" refers to a percentage of the weight of the corresponding element from the total weight of the alloy, and "% by atom (at %)" refers to a percentage of the number of atoms of the corresponding element added to copper from the total number of atoms of the alloy. In the range of "% by weight" or "% by atom", it may be understood that its boundary value is not included if the boundary value is more or less than the value of "% by weight" or "% by atom", but its boundary value is included if the boundary value is in the designated range or is the value of "% by weight" or "% by atom" or more or less.

In the present disclosure, "color coordinates" mean coordinates in the CIE Lab color space, which are color values defined by CIE (Commission International de l'Eclairage), and any positions in the CIE Lab color space may be expressed by three coordinate values of L*, a*, and b*.

In detail, the L* value in the CIE Lab color space indicates brightness (light and shade). When L*=0, it indicates black, and when L*=100, it indicates white. The a* value in the CIE Lab color space indicates whether the color of the corresponding color coordinate is shifted to red or green, with the a* value ranging from −a (negative number) to +a (positive number). When a* is a positive number, it indicates a color shifted to red or purple. When a* is a negative number, it indicates a color shifted to green. The b* value in the CIE Lab color space indicates whether the color of the corresponding color coordinate is shifted to yellow or blue, with the b* value also ranging from −b (negative number) to +b (positive number). When b* is a negative number, it indicates a color shifted to yellow. When b* is a positive number, it indicates a color shifted to blue.

The values of L*, a*, and b* in the CIE Lab color space for the typical painting colors of rose gold color, generally known as the most trending color at present, are illustrated in the following Table 1.

TABLE 1

| Color Name | L* | a* | b* |
|---|---|---|---|
| Tea Rose | 80.68 | 13.32 | 1.19 |
| Rose Quartz | 85.11 | 15.738 | 6.495 |

In the case of a typical painting color representing such rose gold color, the a* value indicating red is remarkably high and the b* value indicating yellow is close to "0". It is impossible to realize such chromaticity values in metal.

The present disclosure is intended to develop a unique metal with a rose gold color using copper. In order to realize the rose gold color in such a metal, when compared to pure copper for chromaticity in the CIE Lab color space, the a* value indicating red should be maintained or high, and the b* value indicating yellow should be increased to a certain value.

When the elements illustrated in the following Tables 2 and 3 are added to the existing pure copper (Cu), the b* value indicating yellow in the CIE Lab color space can be adjusted to increase or decrease compared to the b* value of an existing pure copper according to the amount of each element, whereas the a* value indicating red in the CIE Lab color space decreases. Thus, it is difficult to realize a rose gold color.

TABLE 2

| Element | at % | L* | a* | b* |
|---|---|---|---|---|
| Cu | 100 | 86.76 | 13.76 | 16.83 |
| Zn | 3 | 88.19 | 13.05 | 19.81 |
| Ag | 1 | 85.05 | 13.60 | 16.70 |
| | 3 | 85.50 | 12.98 | 17.00 |
| Mn | 1 | 83.81 | 13.24 | 16.71 |
| | 3 | 87.48 | 10.84 | 15.02 |
| Ni | 1 | 87.80 | 10.03 | 14.22 |
| | 3 | 87.03 | 10.10 | 13.92 |
| A1 | 1 | 86.12 | 13.36 | 17.01 |
| | 3 | 81.41 | 12.07 | 17.05 |
| In | 1 | 85.65 | 12.49 | 16.16 |
| | 3 | 86.44 | 10.11 | 16.24 |
| Sn | 1 | 85.52 | 12.14 | 16.41 |
| | 3 | 85.44 | 9.13 | 15.61 |
| Ga | 1 | 86.73 | 13.62 | 15.81 |
| | 3 | 89.41 | 11.08 | 18.18 |
| Si | 1 | 84.18 | 12.83 | 17.58 |
| | 3 | 83.00 | 11.28 | 16.93 |
| P | 1 | 87.38 | 11.38 | 14.98 |
| | 3 | 87.58 | 9.22 | 13.35 |
| Mg | 1 | 84.59 | 13.48 | 16.28 |
| | 3 | 86.13 | 12.62 | 17.45 |

TABLE 3

| Element | Atomic Fraction | Sum of Elements (at %) | L* | a* | b* |
|---|---|---|---|---|---|
| Pure Cu | — | — | 86.76 | 13.76 | 16.83 |
| Zn:Mn:Ni | 1:1:1 | 1 | 84.96 | 12.70 | 16.27 |
| Zn:Mg:P | 1:1:1 | 1 | 87.54 | 13.06 | 17.82 |
| Mg:Al | 1:1 | 1 | 54.59 | 13.40 | 16.08 |
| Mg:Zn | 1:1 | 1 | 85.60 | 13.05 | 17.13 |
| Al:Zn | 1:1 | 1 | 87.12 | 13.46 | 17.51 |

Accordingly, the present disclosure is characterized to develop a rose-gold-colored copper alloy having a relatively high b* value (yellow) without decreasing an a* value (red) in the CIE Lab color space through an appropriate combination of elements, as compared to an existing copper alloy.

Hereinafter, the rose-gold-colored copper alloy of the present disclosure will be described in more detail with reference to Examples, Comparative Examples, and Experimental Examples.

The composition content of the rose-gold-colored copper alloy in Examples 1 to 3 of the present disclosure is as described in Table 4 below that illustrates the sum of aluminum (Al), magnesium (Mg), and zinc (Zn) in addition to copper (Cu).

TABLE 4

| Classification | Mg (wt %) | Zn (wt %) | Al (wt %) | Cu (wt %) | Sum of Elements (at %) |
|---|---|---|---|---|---|
| Example 1 | 0.06 | 0.17 | 0.07 | Balance | 0.5 |
| Example 2 | 0.14 | 0.4 | 0.16 | Balance | 1 |
| Example 3 | 0.19 | 0.52 | 0.21 | Balance | 1.5 |

As illustrated in Table 4, the rose-gold-colored copper alloy of the present disclosure includes 0.07 to 0.21 wt % of aluminum (Al), 0.06 to 0.19 wt % of magnesium (Mg), 0.17 to 0.52 wt % of zinc (Zn), and a balance of copper (Cu) and unavoidable impurities.

The following Table 5 illustrates L*, a*, and b* values in the CIE Lab color space, which changed when aluminum (Al), magnesium (Mg), and zinc (Zn) are added to copper (Cu) in the amount given below.

TABLE 5

| Element | Atomic Fraction | Sum of Elements (at %) | L* | a* | b* |
|---|---|---|---|---|---|
| Pure Cu | — | — | 86.76 | 13.76 | 16.83 |
| Al:Mg:Zn | 1:1:1 | 1 | 87.45 | 14.35 | 17.45 |
| Al:Mg:Zn | 0.5:1:1.5 | 1 | 86.77 | 14.15 | 16.83 |
| Al:Mg:Zn | 0.5:1.5:1 | 1 | 85.22 | 14.30 | 19.96 |
| Al:Mg:Zn | 1:0.5:1.5 | 1 | 84.80 | 14.36 | 20.38 |
| Al:Mg:Zn | 1:1.5:0.5 | 1 | 82.41 | 15.56 | 20.83 |
| Al:Mg:Zn | 1.5:0.5:1 | 1 | 86.37 | 13.39 | 17.27 |
| Al:Mg:Zn | 1.5:l:0.5 | 1 | 87.42 | 13.14 | 16.79 |

The atomic fraction of aluminum (Al), magnesium (Mg), and zinc (Zn) added to copper (Cu) is preferably 0.5 to 1.5:0.5 to 1.5:0.5 to 1.5. The a* value indicating red in the CIE Lab color space is increased when the condition of the atomic fraction is satisfied.

However, as illustrated in Table 5, the a* value of Al:Mg:Zn=1.5:0.5:1 or Al:Mg:Zn=1.5:1:0.5, in which the amount of aluminum is the same as the sum of magnesium and zinc, is less than that of pure copper. Therefore, in order to satisfy the chromaticity value for realizing the rose gold color, the amount of aluminum should preferably be smaller than the sum of magnesium and zinc (Al<Mg+Zn), and the amount of magnesium (Mg) or zinc (Zn) may be equal to or larger than that of the remaining element.

The physical properties of the rose-gold-colored copper alloy of the above Examples are evaluated according to the following items, and the results thereof are illustrated in Table 6 below.

For production of the alloy, the test specimen for physical property evaluation is prepared in the amounts illustrated in the above Examples in a high-frequency vacuum electric induction furnace reactor. The test specimen is made as a sheet having a thickness of 0.2 mm or less, which is applicable to the vehicle interior material, by performing solution treatment on a cast specimen at 800° C. for 6 hours—the solution treatment condition for typical copper—and then rolling the solution-treated specimen at a reduction ratio of 20% at 500° C., which is a recrystallization temperature of the copper alloy. Meanwhile, no rolling bond is performed on the specimen according to the Examples of the present disclosure.

Here, the dictionary definition of "sheet" means a plate of 3 mm or less, but the "sheet" in the present disclosure refers to a plate of copper alloy having a thickness of 0.2 mm or less for application to the vehicle interior material.

When metal is generally used for a vehicle interior material, it is desired to make the metal thin since it is overlapped with plastic for injection molding. A typical sheet of 0.5 mm to 0.7 mm in thickness is used for an existing aluminum interior material, in which case the copper alloy needs to be rolled thinner than aluminum in consideration of the specific gravity of the vehicle. Accordingly, the rose-gold-colored copper alloy of the present disclosure is preferably a sheet of 0.2 mm or less in thickness. If the thickness of the rose-gold-colored copper alloy exceeds 0.2 mm, the weight thereof becomes too large to be used for the vehicle interior material due to large specific gravity. Therefore, it is preferable that the rose-gold-colored copper alloy has the above thickness.

The Vickers hardness (Hv) test is performed to determine the surface hardness of the test specimen prepared as described above, and the surface hardness thereof is measured under a test load of 9.8 N.

In order to determine chromaticity values, the L*, a*, and b* values of the test specimen are measured in the CIE Lab color space in the present disclosure.

Specifically, the observer's angle is set to 10 degrees since the wavelength of light may vary depending on the viewing angle of color in color measurement. D65 is used as a standard light source since reflection and an observed color difference are generated depending on the value of the incident wavelength. The size of the measurement aperture is set to 6 mm in order to minimize an error in the influence of the surface roughness during metal measurement. The chromaticity value is measured by making the surface roughness uniform through 0.5 micron polishing.

TABLE 6

| Classification | Composition | Surface Hardness (Hv) | Color Difference L* | a* | b* | Note |
|---|---|---|---|---|---|---|
| Comparative Example 1 | Pure Cu | 65 | 86.76 | 13.76 | 16.83 | Commercial Alloy |
| Example 1 | Cu-0.5at % (Al, Mg, Zn) | 70 | 87.45 | 13.82 | 16.92 | |
| Example 2 | Cu-1at % (Al, Mg, Zn) | 75 | 82.55 | 15.76 | 19.72 | |
| Example 3 | Cu-1.5at % (Al, Mg, Zn) | 80 | 85.57 | 14.35 | 17.45 | |
| Comparative Example 2 | Cu-2at % (Al, Mg, Zn) | 90 | 88.16 | 13.03 | 16.04 | |

The a* value indicating red in the CIE Lab color space increases from the a* value for the existing copper only when the sum of the elements satisfies the above range. As illustrated in the above Table 6, when the sum of aluminum (Al), magnesium (Mg), and zinc (Zn) is 2 at % or more as in Comparative Example 2, the a* value indicating red in the CIE Lab color space decreases compared to the a* value for the existing copper in Comparative Example 1. Hence, the rose gold color is not realized. Accordingly, the sum of aluminum (Al), magnesium (Mg), and zinc (Zn) is preferably 0.5 to 1.5 at %.

The rose-gold-colored copper alloy of Examples 1 to 3 has a surface hardness of 70 Hv or more and thereof is further hardened and improved compared to that of the copper alloy having a copper content of 99% in Comparative Example 1.

Meanwhile, FIG. 1 illustrates the color coordinate values (L*, a*, and b*) in the CIE Lab color space for existing copper, red copper, bronze, and brass and the rose-gold-colored copper alloy of the present disclosure. As illustrated in FIG. 1, the rose-gold-colored copper alloy of the present disclosure is produced in which the a* value (red) does not decrease and the b* value (yellow) is relatively high in the CIE Lab color space, compared to the existing copper, red copper, bronze.

The rose-gold-colored copper alloy of the present disclosure is produced to have a rose gold color by controlling the amounts of elements added thereto within a range in which no precipitate or crystallization is formed. As described above, since no precipitate or crystallization is formed in the rose-gold-colored copper alloy of the present disclosure, the rose-gold-colored copper alloy is well rolled and has a surface hardness equal to or more than the conventional copper alloy having a copper content of 99%. It is thus obvious that the rose-gold-colored copper alloy is suitable for the vehicle interior material having a thickness of 0.2 mm or less.

In accordance with one form of the present disclosure, it is possible to produce the rose-gold-colored copper alloy since aluminum (Al), magnesium (Mg), and zinc (Zn) are added to copper (Cu) at a specific content and element ratio so that the a* value indicating red is higher in the CIE Lab color space representing color compared to the existing copper alloy and the b* value indicating yellow increases.

The rose-gold-colored copper alloy of the present disclosure maintains the same formability as the existing copper alloy while having high hardness. Therefore, the rose-gold-colored copper alloy can be easily used as parts for vehicle interior materials.

While the present disclosure has been described with respect to the specific variation, it will be apparent to those skilled in the art that various changes and modifications may be made without departing from the spirit and scope of the present disclosure as defined in the following claims.

What is claimed is:

1. A vehicle interior material made of copper alloy comprising 0.07 to 0.21 wt % of aluminum (Al), 0.06 to 0.19 wt % of magnesium (Mg), 0.17 to 0.52 wt % of zinc (Zn), and a balance of copper (Cu) and unavoidable impurities, wherein the sum of the aluminum (Al), the magnesium (Mg), and the zinc (Zn) is 1.0 at %, and wherein the atomic ratio of aluminum (Al):magnesium (Mg):zinc (Zn) is one of 0.5:1:1.5, 0.5:1.5:1, 1:0.5:1.5 or 1:1.5:0.5, and wherein the amount of aluminum (Al) is smaller than the sum of magnesium (Mg) and zinc (Zn), and the amount of magnesium (Mg) or zinc (Zn) is equal to or larger than that of the remaining element, and wherein the copper alloy has an L* value of 82.41 to 86.77, an a* value of 14.15 to 15.56, and a b* value of 16.83 to 20.83 in the CIE Lab color space.

2. The vehicle interior material of claim 1, wherein the amount of aluminum is smaller than the sum of magnesium and zinc.

3. The vehicle interior material of claim 1, wherein free of precipitate or crystallization is formed in the copper alloy.

4. The vehicle interior material of claim 1, wherein the copper alloy has a thickness of 0.2 mm or less during hot rolling at a reduction rate of 20% at 500° C.

5. The vehicle interior material of claim 1, wherein the copper alloy has a surface hardness of 70 Hv or more.

6. A copper alloy comprising:

0.07 to 0.21 wt % of aluminum (Al);

0.06 to 0.19 wt % of magnesium (Mg);

0.17 to 0.52 wt % of zinc (Zn); and a balance of copper (Cu) and unavoidable impurities, wherein the sum of the aluminum (Al), the magnesium (Mg), and the zinc (Zn) is 1.0 at %, and wherein the atomic ratio of aluminum (Al):magnesium (Mg):zinc (Zn) is one of 0.5:1:1.5, 0.5:1.5: 1, 1:0.5:1.5 or 1:1.5:0.5, and wherein the amount of aluminum (Al) is smaller than the sum of magnesium (Mg) and zinc (Zn), and the amount of magnesium (Mg) or zinc (Zn) is equal to or larger than that of the remaining element, and wherein the copper alloy has an L* value of 82.41 to 86.77, an a* value of 14.15 to 15.56, and a b* value of 16.83 to 20.83 in the CIE Lab color space.

7. The copper alloy of claim 6, wherein the amount of aluminum is smaller than the sum of magnesium and zinc.

8. The copper alloy of claim 6, wherein free of precipitate or crystallization is formed in the copper alloy.

9. The copper alloy of claim 6, wherein the copper alloy has a thickness of 0.2 mm or less.

10. The copper alloy of claim 6, wherein the copper alloy has a surface hardness of 70 Hv or more.

* * * * *